United States Patent [19]

Zuber

[11] Patent Number: 4,783,853

[45] Date of Patent: Nov. 15, 1988

[54] PROTECTIVE BODY SUIT

[76] Inventor: Christopher T. Zuber, 5741 Buena Vista, Oakland, Calif. 94618

[21] Appl. No.: 40,543

[22] Filed: Apr. 17, 1987

[51] Int. Cl.[4] ..... A41D 13/00; A42B 3/02; F41H 1/02

[52] U.S. Cl. ..... 2/2; 2/2.5; 2/412; 2/424; 36/15

[58] Field of Search ..... 2/2, 2.5, 16, 22, 46, 2/69, 412, 414, 424, 10; 36/15, 101

[56] References Cited

U.S. PATENT DOCUMENTS

| | | | |
|---|---|---|---|
| 1,066,305 | 7/1913 | Mitchell | 36/15 |
| 1,269,019 | 6/1918 | Szmyt | 2/2.5 |
| 4,198,707 | 4/1980 | Haupt et al. | 2/2.5 |
| 4,346,205 | 8/1982 | Hiles | 428/423.3 X |
| 4,370,754 | 2/1983 | Donzis | 2/2 |
| 4,577,346 | 3/1986 | Hall | 2/2 |
| 4,580,296 | 4/1986 | Cane | 2/2 |

*Primary Examiner*—Stuart S. Levy
*Assistant Examiner*—Joseph J. Hail, III
*Attorney, Agent, or Firm*—Owen, Wickersham & Erickson

[57] ABSTRACT

A body-protective article comprising matched portions of a rigid, non-shattering, high-impact resistant polymer, interiorly lined with an adherent high-impact absorbing elastomer. A protective body suit may comprise a series of interconnected segments providing a unitary suit, made up of such matched portions. The polymer is chosen from the group consisting of polyvinyl chloride, polyethylene, polypropylene, nylon, and polyester, and each of a sufficient molecular weight to make it rigid and non-shattering. The elastomer comprises flexible polyurethane of essentially linear structure containing unsatisfied hydroxyl groups, and having a compression set less than 15%, an elongation at break of at least 500% and a recovery which is delayed after compression by at least 0.7 sec. The matched portions have fixed adjacent interlocking edges that enable the user to enclose a body portion therein. Closures hold the matched portions together. Adjacent segments are usually connected together.

24 Claims, 4 Drawing Sheets

PROTECTIVE BODY SUIT

FIELD OF INVENTION

The present invention is directed to a protective body armor garment for the protection of the body from injury, especially impact-related injuries.

BACKGROUND OF THE INVENTION

Injuries may result from the collision of a person with a non-yielding object, either a moving object (a vehicle or another person), or a stationary object (a wall, a barrier, tree, etc.), or the impact of a projectile, such as a bullet. Thus, the protective garment of the present invention may be used as protective gear for various sports, especially those where protection from high speeds or high-impact collisions is important, such as skiing, motorcycle racing, motorcross, auto racing, and flying private planes, or non-athletic activities which tend to produce injuries.

Many types of protective equipment have been directed toward protecting the user from shock-related injury resulting from contact with other participants, sports equipment, or the ground.

For example, various protective pads for different parts of the body are common in the art. U.S. Pat. No. 4,484,360 discloses a padded shin guard comprising a dense polyurethane shell padded with polyurethane foam; U.S. Pat. No. 4,486,901 discloses a multi-layered shock-absorbing structure with an air-impermeable shell surrounding an assembly of three open-celled foams. U.S. Pat. No. 4,484,361 discloses fitted elbow and knee pads of the same materials. Energy-absorbing elastomers and compositions are also disclosed in U.S. Pat. Nos. 4,101,704, 4,346,205, and 4,476,258. Other forms of protective clothing include protective articles for the torso, such as available-pressure rib cage pad in U.S. Pat. No. 4,370,754, an athletic padded garment as shown in U.S. Pat. No. 4,577,346, a body protective vest as disclosed in U.S. Pat No. 4,302,847, and various chest protectors common to both football and baseball. Fully protective body suits are also known in the art.

Improvements in available materials, however, make it possible to improve the protection, just as higher speeds in many sports increase the dangers.

Therefore, an important object of the present invention is to provide an improved protective combination.

Another object of the present invention is to provide a segmented interconnected protective body suit offering improved protection for the whole body.

Still another object of the present invention is to provide a segmented protective body suit that can be folded, carried, or stored and is simple in structure.

SUMMARY OF THE INVENTION

The foregoing objects and advantages of the present invention are achieved in the embodiments illustrated herein.

My new protective product is a combination of a non-shattering, impact-resistant, stiff plastic shell lined with a special elastomer of very low compression set and a slow recovery from compression.

The plastic shell may be made of suitable polyvinyl chloride, polyethylene, polypropylene, polyurethane, nylon, or polyester such as Delrin (a registered trademark), in the impact-resistant, stiff forms. The material used is of sufficiently high molecular weight to make it rigid and non-shattering.

The special elastomer is a flexible polyurethane of essentially linear structure containing unsatisfied hydroxyl groups. It is the reaction product of substantially linear polyols having hydroxyl end groups and an average molecular weight in the range of 600 to 1200, with an aromatic isocyanate in less than stoichiometric amount. This material is described and claimed in U.S. Pat. No. 4,346,205, which is hereby incorporated by reference into this application.

This special elastomer is cemented or otherwise adhered or bonded to the plastic shell by a suitable adhesive, such as neoprene in a suitable solvent, which adheres to both the padding and the shell.

The resultant combination may be shaped to protect any one of several body parts. It may be made in segments and two or more segments may be connected together.

A series of interconnected segments can provide a unitary protective body suit which protects the user from impact-related shock. Each of the segments include matched portions of the rigid, non-shattering, impact-resistant polymeric compound with the impact-absorbing inner lining of specific elastomer which is bonded to the shell. Body segments may be provided for the shoulders, torso, upper arms, forearms, hands, buttocks, thighs, and shins, and may be provided also for the feet and for the head.

The impact-absorbing inner lining comprises a high-energy absorbing elastomer which is safe for prolonged skin contact and resists chemical and biological attack. It also provides a high degree of vibration isolation.

Each or any segment can be provided with heating or cooling means.

The body segments may be joined together at adjoining fixed edges by nylon mesh strips riveted to the body segments. Preferably, adjoining segments may provide cooperating tongue-and-groove joints that help to hold the alignment and prevent slippage and hence crushing. Adjustable velcro closures or seat-belt type buckles preferably made of super-tough nylon may be attached to nylon mesh strips riveted to open edges of each body segments opposite the fixed edges of each body segment. The open edges enable the user to enclose high body parts within a pair of segments, and the velcro or buckle closures enable the user to close and secure or open apart the pair or series of body segment.

Body segments when provided for the feet comprise boots made of the same polymeric compound as the segment shells lined with the same energy-absorbing elastomer. The boots also may include interchangeable soles comprised of a hard, non-wearing plastic material, such as super-tough nylon. The soles may be removably attached to the boots by heel screws and a tongue and groove combination in the toe portion of the sole and boot.

A helmet may be provided for protecting the user's head, cooperating with the shoulder segment, as by a tongue-and-groove connection to preclude spinal compression upon impact. The helmet, also, incorporates the same polymeric shell material and the same impact-resistant elastomer. The elastomer also provides acoustical dampening and vibration isolation.

The body suit can be worn over undergarments or clothing. The user is able to put on and remove the body suit without assistance.

The present invention will be more readily understood from a consideration of the following detailed description of a preferred embodiment thereof presented in conjunction with the accompanying drawing.

DETAILED DESCRIPTION OF THE PREFERRED EMBODIMENT

Figure 1:
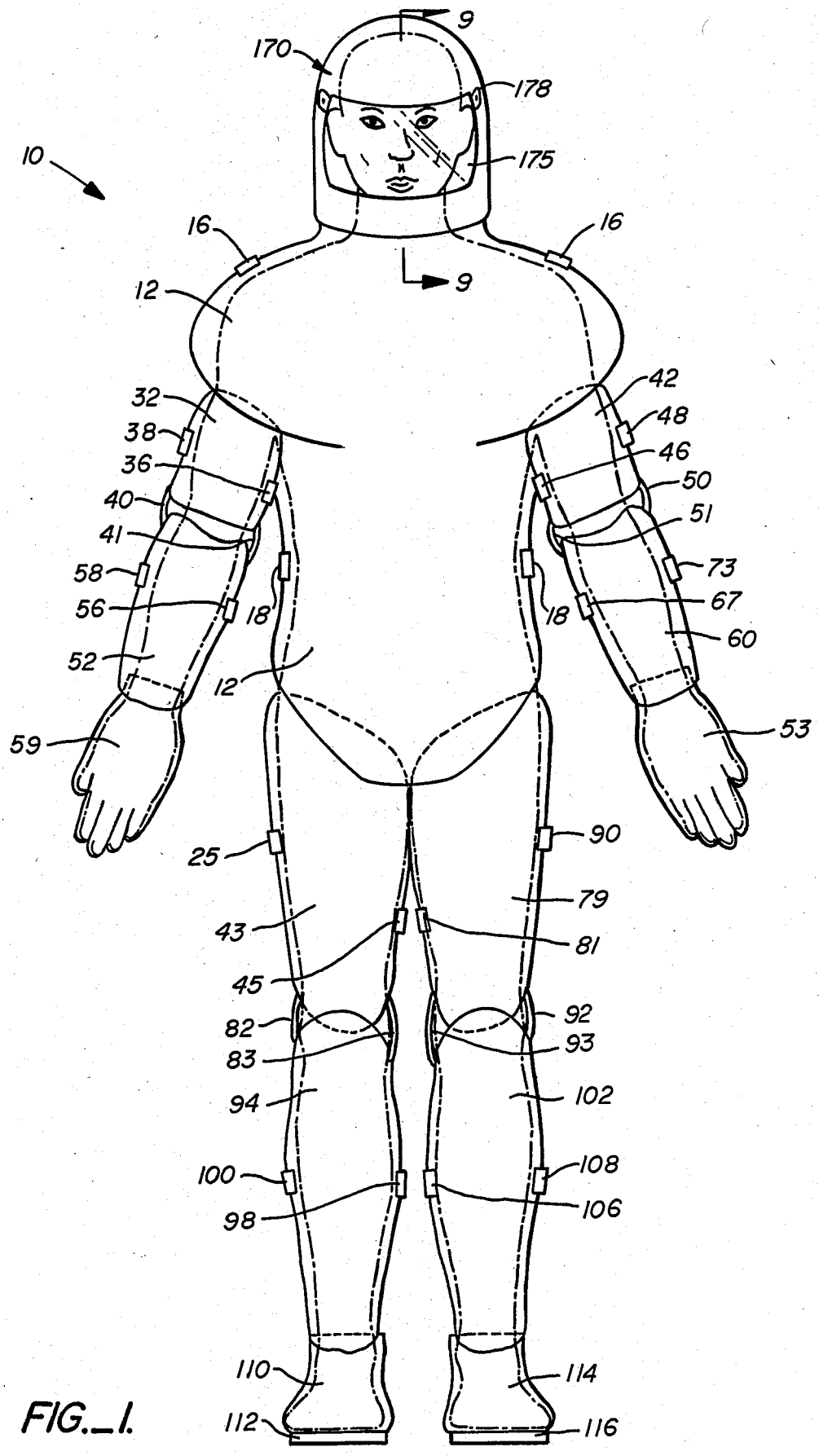
FIG. 1 is a front view of the protective body suit embodying the principles of the present invention, being worn by a user.
Figure 2:
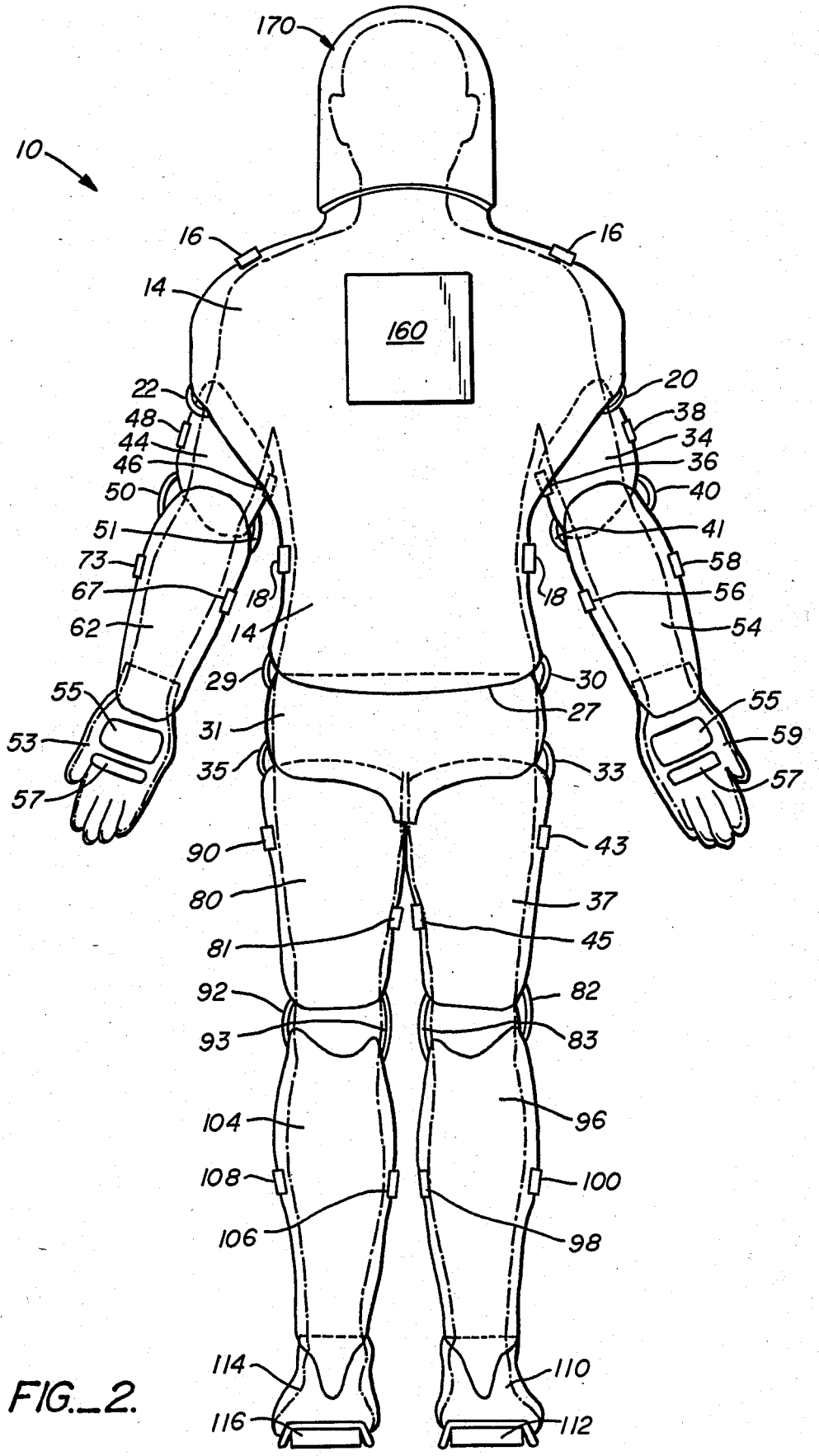
FIG. 2 is a rear view of the protective body suit of FIG. 1.

In accordance with the principles of the present invention, a protective body suit 10, as shown in FIGS. 1 and 2, may be provided in the form of a series of interconnected segments. The segments are matched portions comprising (See FIG. 6A) a combination of a shell 11 made of hard, light weight, rigid, non-shattering impact-resistant polymeric compound lined with a high-energy-absorbing elastomer 13 which protects the user from injury due to shock-related impact. The shell portions 11 are preferably made by a molding process. The elastomer lining 13 may be adhered to the inner surface of the portions by conventional adhesives known in the art. Preferably, the lining 13 has a series of grooves 15 on its interior surface to assist in its compressing.

As stated before, the polymeric compound 11 is a non-shattering, impact-resistant, stiff, substantially rigid form of high-molecular-weight polyvinyl chloride, polyethylene, polypropylene, polyurethane, nylon, or polyester. The elastomer 13 is flexible polyurethane of essentially linear structure containing unsatisfied hydroxyl groups, and having a compression set less than 15%, an elongation at break of at least 500% and a recovery which is delayed after compression by at least 0.7 sec. This elastomer comprises the reaction product of substantially linear polyols based on polyalkylene glycol and having an average molecular weight in the range of 600 to 1200, and an aromatic diisocyanate. Preferably, it has compression set at room temperature less than 5% and Shore (00) hardness in the range 0 to 50, preferably in the range of 1 to 20. Preferably, its recovery delay is at least 2 seconds.

Preferably, the diisocyanate is 4,4 diphenylmethane diisocyanate. The elastomer may contain 0.002 to 0.004 gram of unsatisfied OH groups per gram, preferably 0.0023 to 0.0034 gram of unsatisfied OH groups per gram.

This elastomer may contain an anti-tack agent, e.g., a silcone polycarbinol, such as a polypropylene oxide-siloxane copolymer, the proportion of agent being not more than 2% by weight of the elastomer.

FIG. 1 shows for a front view of the body suit 10, and FIG. 2 shows a rear view. There is a matching front shoulder and torso portion 12 and a rear shoulder and torso portion 14. Like the segments shown in FIG. 6A, one of the portions 12 or 14 has a groove 17 along its edge 19, and where it meets this mating member 14 or 12, and the portion 14 or 12 has a tongue 21 along its edge 23 where it meets its mating member 12 or 14. The edge portions 25 at the lower end of the front shoulder-and-torso member 12 and the edge portions 27 at the lower end of the rear member 14 do not have either a tongue or groove; the side portions prevent these edge portions from being crushed. Thus, in all pairs of segments, the edges that meet to enclose a body member have a tongue-and-groove connection, and those that do not meet do not have either a tongue or a groove. If desired, the portions 12 and 14 may be a single member, placed on the user, from above, to enclose his shoulders and torso.

A nylon mesh strip 16 is riveted to adjoining edges of both the front shoulder and torso portion 12 and the rear shoulder and torso portion 14 to connect these portions 12 and 14 together. Riveted nylon mesh connection means, such as the strips 16, are used throughout my protective body suit 10 to connect adjoining edges of matched body portions (e.g., front and rear portions) and are also used to connect adjacent body segments together.

Thus, FIGS. 4, 5, 6, and 6A show a pair of segments 60 and 62 enclosing the left forearm. The shell 61 of the front segment 60 and the shell 63 of the rear segment 62 are permanently riveted by rivets 64 and 65 to opposite ends of a strip 66 (like the strip 16), which permanently connects the segments 60 and 62 together. A second nylon strip 67 is secured to the front forearm segment 60 by rivets 68 and has a loop portion 69 encircling one member 70 of a rectangular ring 71 and permanently attached to itself. A third nylon strip 73 is secured to the rear forearm segment 62 by rivets 74. This third strip 73 has a two velcro portions 75 and 76 thereon.

When the forearm has been encircled by the two segments 60 and 62, as in FIGS. 1 and 2 the tongue 21, at that time engaging the groove 17 adjacent to the strip 66, the third strap 73 is looped through the ring 71, going around a member 77, and the end 78 is pulled through the ring 71, and when a good fit of the segments 60 and 62 around the forearm is obtained, with the tongue 21 and groove 17 on that side interlocked, the two velcro portions 75 and 76 are attached to each other and hold the segments 60 and 62 together.

This description of the connection of the two left forearm segments 60 and 62 is illustrative of how all the segment pairs are secured around the body members.

An adjustable velcro closure 18 riveted to adjacent edges of the shoulder-torso pair of segment 12 and 14 opposite the adjoining edges connected by the nylon mesh cord 16, enable the user to removably close and secure the shoulder segment about his shoulders.

A front right upper arm segment 32 and a rear right upper arm segment 34 comprise the right upper arm pair of segments. A nylon mesh strip 36 riveted, as described above to adjoining edges of both the front and rear upper arm portions 32 and 34 permanently connects this pair of segments 32 and 34 together. An adjustable nylon-strip-and-velcro closure 38, like that already described, is riveted to adjacent edges of the right upper arm pair of segments, opposite the adjoining edges connected by the nylon mesh strip 36, enables the user to put on and take off the right upper arm pair of segments 32 and 34. The edges of the segments 32 and 34 are, again, provided with a tongue-and-groove structure like that shown in FIGS. 5 and 6.

The left upper arm pair of segments 42 and 44 are similarly joined by a nylon mesh strip 46 and an adjustable velcro-nylon strip closure 48, in combination with the interlocking edges and their tongue and groove structure.

The left forearm pair of segments 60 and 62 have already been described in detail. The right forearm pair of segments 52 and 54 are similar as are the nylon strip 56, the nylon-velcro-buckle structure 58, and the tongue-and-groove edges.

The upper and lower arm pairs of segments may be left separate or may be joined together as shown in FIGS. 1 and 2. Thus, nylon mesh strips 40 and 41 and the similar strips 50 and 51 are riveted to opposite sides of the lower rear edge of the upper arm pairs of segments 32, 34 and 42, 44 and the adjacent upper edges of the forearm pairs of segments 52, 54 and 60, 62 to connect the adjacent segments together and the sides of the elbows, leaving plenty of slack. Hinges may be used at the elbows instead of the nylon mesh strips.

The upper arm pairs of segments 32, 34 and 42, 44 may be separate from the torso segment 14 or may be joined thereto, with some slack by nylon strips 20 and 22 (FIG. 2). Similarly, strips 29 and 30 may join the rear torso portion 14 to a buttocks-protecting segment 31, which has no matching portion but, though uniquely shaped, is basically structured like the other segments with a shell and the elastomer.

Figure 4:
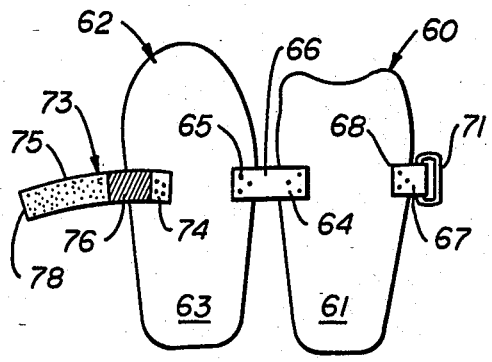
FIG. 4 is a top plan view of a pair of segments embodying the principles of the invention laid open, showing both connecting and closure means between matched portions of the segment.
Figure 6:
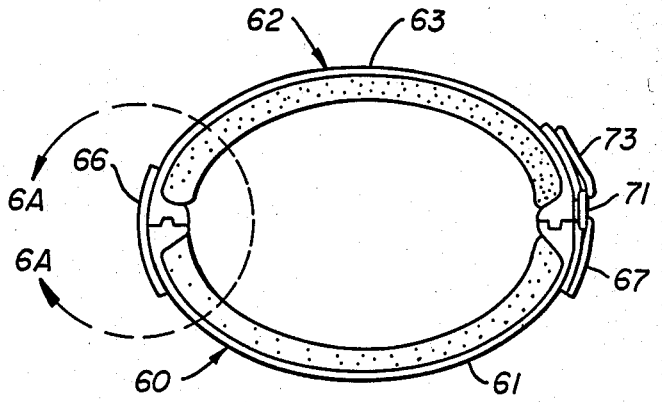
FIG. 6 is an end view of the pair of segments of FIG. 4 shown in a closed and secured configuration.
Figure 5:
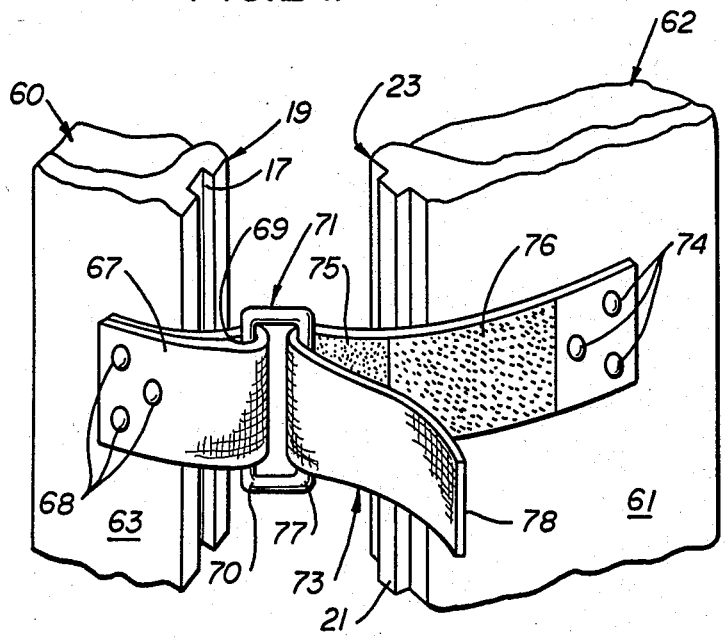
FIG. 5 is an enlarged view of a portion of the segments of FIG. 4, showing the tongue-and-groove edges and the nylon mesh closure means prior to closing.
Figure 6A:
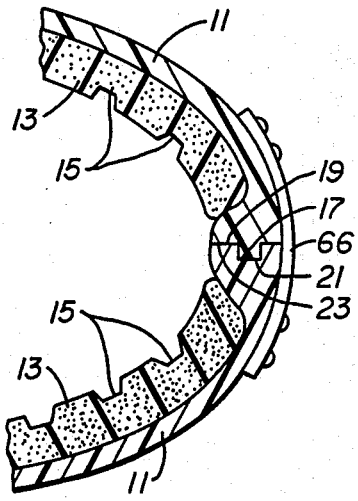
FIG. 6A is an enlarged view in section taken along the line 6A—6A in FIG. 6. It also represents in a general way any of the segments of the invention.

A front right thigh segment 39 and a rear thigh segment 37 comprise the right thigh pair of segments. These are basically like what is shown in FIGS. 4–6. A nylon mesh strip 45 is riveted to adjoining edges of both the front and rear right thigh segments 39 and 37 to join these portions together. An adjustable nylon-strip-and-velcro closure 43 with a buckle is riveted to adjacent edges of the right thigh pair of segments, opposite the adjoining edges connected by the nylon mesh strip 45, enable the user to removably close and secure the right thigh pair of segments. Again the mating edges of the segments 39 and 37 have an interlocking tongue-and-groove structure. Nylon mesh cords 82 and 83 may be riveted to the lower rear corners of the right thigh pair of segments 39 and 37 and the upper rear corners of the right shin pair of segments 94 and 96 to permanently join these segments together, with plenty of slack, or hinges may be used.

A front left thigh segment 79 and a rear left thigh segment 80 comprise the left thigh pair of segments. A nylon mesh strip 81 is riveted to adjoining and interlocking, tongue-and-groove edges of both the front and rear left thigh segments 79 and 80 and connects these portions together. An adjustable velcro-type closure 90 is riveted to adjacent edges of the left thigh pair of segments 79 and 80, opposite their adjoining interlocking edges. Nylon mesh strips 92 and 93 are riveted to the lower rear corners of the left thigh pair of segments and the upper rear corners of the left shin pair of segments permanently join these pairs of segments together. The thigh segments 79 and 80 may be connected to the buttocks portion 31 by nylon strips 33 and 35.

Similarly, a front right shin segment 94 and a rear right shin segment 96 comprise the right shin pair of segments. Again, these are interlocking tongue-and-groove edges, a nylon strap 98 riveted to adjoining edges of both the front and rear right shin segments 94 and 96, and an adjustable velcro closure 100 riveted to adjacent edges of the right shin pair of segment. A front left shin segment 102 and a rear left shin segment 104 comprise the left shin pair of segments. A nylon mesh strip 106 is riveted to adjoining, interlocking edges of both the front and rear left shin pair of segments 102 and 104, and permanently connect those portions together. An adjustable nylon-strip and velcro closure 108 is riveted to adjacent edges of the left shin segment, opposite the adjoining interlocking edges.

A right hand glove 59 and a left hand glove 53 may be provided to protect the user's hands. Both gloves 59 and 53 may be standard leather gloves with the addition of two stiff plates or hard reinforcements 55 and 57 (FIG. 2), one on the dorsal side or back of the hand and the other over the rear of the third digit, to protect them while leaving the hand available for use. Each plate 55 and 57 has a shell and a padding, as described above.

Figure 3:
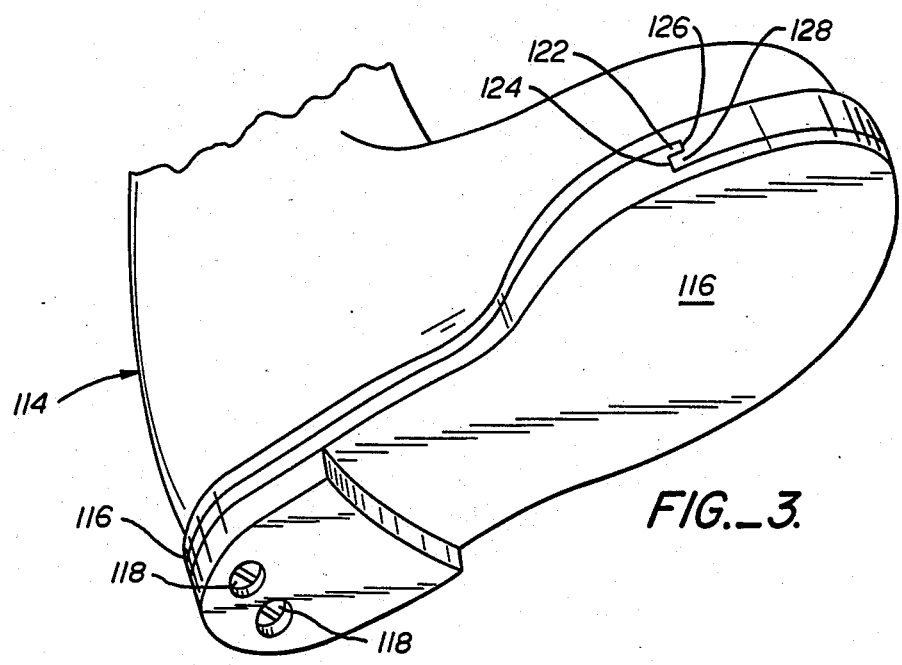
FIG. 3 is a bottom view in perspective of the interchangeable sole of a foot protective segment embodying the principles of the invention.

A right foot portion 110 comprises a boot made of the same rigid, non-shattering, impact-resistant plastic material lined with the same energy absorbing elastomer as the other body portions. The boot 110 includes an interchangeable hard plastic, non-wearing sole 112. A left foot portion 114 and interchangeable sole 116 are also provided. Both soles 112 and 116 may be attached by a plurality of screws 118 and a tongue-and-groove arrangement, as seen in FIG. 3. A tongue 122 and a groove 124 of the sole mesh with a groove 126 and tongue 128 of the boot, to interlock the sole with the boot.

Figure 7:
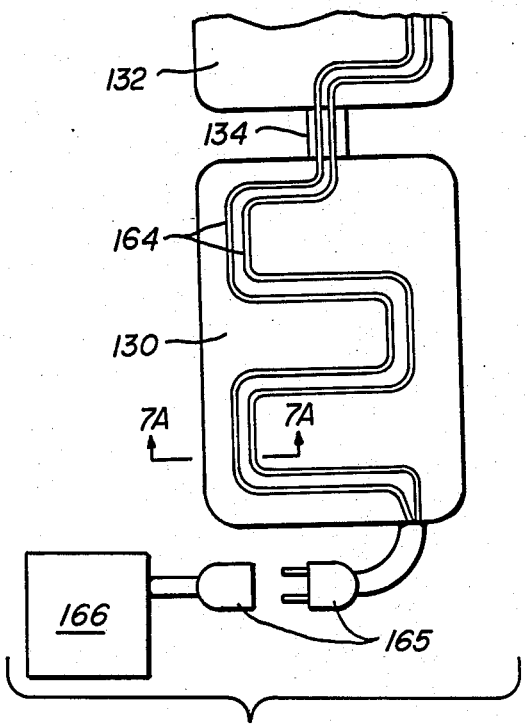
FIG. 7 is a diagrammatic view of padding portions of two segments showing a fluid heating or cooling system incorporated therein.
Figure 7A:
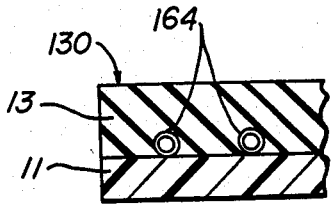
FIG. 7A is an enlarged view in section of one of the completed segments of FIG. 7 taken along the line 7A—7A in FIG. 7.
Figure 8:
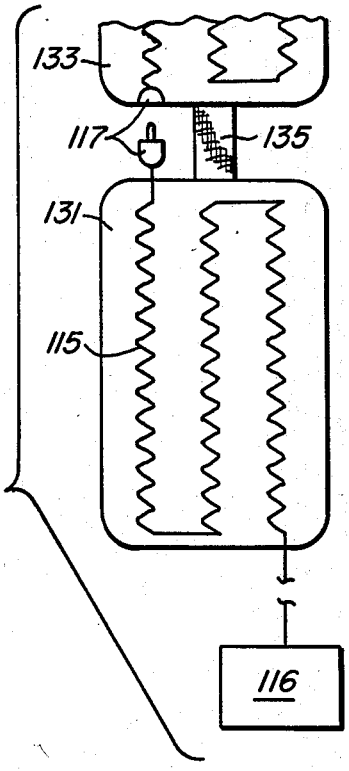
FIG. 8 is a diagrammatic view of the padding portions of two segments showing electrical heating means incorporated therein.

FIGS. 7 and 8 show a heating or cooling system for the suit 10. In FIGS. 7 and 7A a conduit system 164 is provided which is connected by a plug and socket arrangement 165 to a pump 166, which may include an electrical heater and may be carried in a container 160 secured to the rear torso segment 14 (FIG. 2). FIG. 8 shows an all-electrical system comprising resistance wiring 115 and a battery 116 (which may be housed in the container 160). A plug-and-socket arrangement 117 may connect successive segments together.

Figure 9:
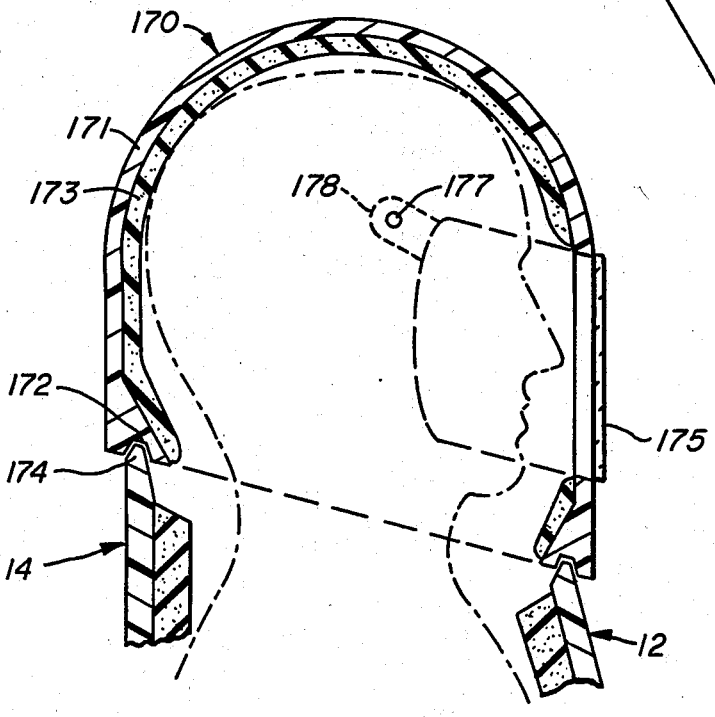
FIG. 9 is a view in section of the same along the line 9—9 in FIG. 1, with a wearer's head shown therein in broken lines.

A helmet 170 (FIGS. 1, 2, and 9) may also be provided and is of a similar construction to the other segments of my body suit. It is composed of rigid, high-impact, non-shattering, impact resistant, polymeric compound 171, lined with a high energy absorbing elastomer 173 which protects the user from injury, due to shock related impact. This is especially important for the head, as head injuries are the leading cause of death in this kind of accident. The helmet 170 has a groove 172 around its lower edge which cooperates with the tongue element 174 of both shoulder portions 12 and 14 to preclude spinal compression upon impact. A clear polymeric face shield 175, commonly known to those knowledgeable in the art of "full faced" helmets (such as plexiglass). It is the only place in the interior of the helmet that is not lined with the above-mentioned high-energy-absorbing elastomer, as that would preclude the wearer from seeing out of the helmet.

The face shield 175 slides back in the conventional manner, and is attached to a shell hinge portion of the shell 171 of the helmet 170 by a hinge screw 177. A hinge bracket 178 attached to the face shield 175 enables the wearer to rotate the face shield in a counterclockwise manner.

The protective body suit 10 of the present invention provides to human user protection from shock related injury while enable them to move freely and engage in vigorous, otherwise dangerous, activities.

To those skilled in the art to which this invention related, many changes in construction and widely differing embodiments and applications of the invention will suggest themselves without departing from the spirit and scope of the invention. The disclosures and descriptions herein are purely illustrative and are not intended to be in any sense limiting.

What is claimed is:

1. A body-protective article providing protection for a human user from impact-related shock comprising:

matched portions of a rigid, non-shattering, high-impact resistant polymer, interiorly lined with high-impact absorbing elastomer adhered to said polymer, said polymer being chosen from the group consisting of polyvinyl chloride, polyethylene, polypropylene, nylon, and polyester, and each of a sufficient molecular weight to make it rigid and non-shattering, said matched portions having fixed adjacent interlocking edges that enable the user to enclose a body portion therein, and closure means holding said matched portions together.

2. The article of claim 1, wherein said elastomer comprises flexible polyurethane of essentially linear structure containing unsatisfied hydroxyl groups, and having a compression set less than 15%, an elongation at break of at least 500% and a recovery which is delayed after compression by at least 0.7 sec.

3. The article of claim 2 wherein said elastomer comprises the reaction product of substantially linear polyols based on polyalkylene glycol and having an average molecular weight in the range of 600 to 1200, and an aromatic diisocyanate.

4. The article of claim 3 wherein said elastomer has a compression set at room temperature less than 5% and a Shore 00 hardness in the range 0 to 50.

5. The article of claim 4 wherein the Shore 00 hardness is in the range of 1 to 20.

6. The article of claim 3 wherein the diisocyanate is 4.4 diphenylmethane diisocyanate.

7. The article of claim 6 wherein the elastomer contains 0.002 to 0.004 gram of unsatisfied OH groups per gram.

8. The article of claim 7 wherein the elastomer contains 0.0023 to 0.0034 gram of unsatisfied OH groups per gram.

9. The article of claim 2 wherein the recovery delay is at least 2 seconds.

10. The article of claim 2 wherein the elastomer contains, as an anti-tack agent, a silicone polycarbinol, the agent being present in an amount of not more than 2% by weight of the elastomer.

11. The article of claim 10 wherein the carbinol is a polypropylene oxide-siloxane copolymer.

12. A protective body suit providing protection for a human user from impact-related shock comprising:

a series of interconnected segments providing a unitary suit, said segments being matched portions of a rigid, non-shattering, high-impact resistant polymeric compound, said polymeric compound being chosen from the group consisting of polyvinyl chloride, polyethylene, polypropylene, nylon and polyester, each of sufficient molecular weight to make it rigid and non-shattering, interiorly lined with a high-impact absorbing elastomer, said matched portions having fixed adjacent interlocking edges that enable the user to enclose a body portion therein, and said segments having fixed adjacent edges and open edges, to enable the user to enclose his body parts within said segments, mating edges of said matched portions providing a tongue-and-groove connection, closure means for closing and securing said segments around the user's body parts, and connecting means for joining adjacent body segments together.

13. The protective body suit of claim 12 wherein said segments are provided for the shoulders and torso, the upper arms, the forearms, the buttocks, the thighs, and the shins.

14. The protective body suit of claim 13 wherein said segments are provided for the feet.

15. The protective body suit of claim 14 wherein said body segments for the feet comprise boots having interchangeable soles removably attached to said boots by heel screws and a tongue and groove combination in the toe portion on the underside of said boots.

16. The protective body suit of claim 15 wherein said interchangeable sole are comprised of a hard, non-wearing plastic material.

17. The protective body suit of claim 12 wherein said impact-absorbing elastomer has a compression set at room temperature of less than 5% and a hardness on the Shore 00 scale not exceeding 50.

18. The protective body suit of claim 12 wherein said connecting means comprise nylon mesh strips riveted to adjacent fixed edges of said body segments.

19. The protective body suit of claim 18 wherein said closure means comprise hook and pile closure means attached to nylon mesh strips.

20. The protective body suit of claim 19 wherein said hook and pile closure means are adjustable to various lengths according to the size of the user's body.

21. The protective body suit of claim 12 wherein said segments are provided with electrical heating means.

22. The protective body suit of claim 12 wherein said segments are provided with a liquid heating and cooling system, said suit having a pump therefor.

23. The protective body suit of claim 12 including a helmet for protecting the user's head, said helmet connected to and cooperating with a said shoulder segment to preclude spinal compression.

24. The protective body suit of claim 23 wherein said helmet and said shoulder segment have interlocking tongue and groove connections

* * * * *